US005213427A

United States Patent [19]

Grosse et al.

[11] Patent Number: 5,213,427

[45] Date of Patent: May 25, 1993

[54] PRINTER WITH SHEET STORAGE CASSETTE

[75] Inventors: Hatto Grosse, München; Harald Schulz, Berlin, both of Fed. Rep. of Germany

[73] Assignee: Mannesmann Aktiengesellschaft, Düsseldorf, Fed. Rep. of Germany

[21] Appl. No.: 772,250

[22] Filed: Oct. 7, 1991

[30] Foreign Application Priority Data

Apr. 5, 1989 [EP] European Pat. Off. ..... 89730094

[51] Int. Cl.[5] ..... B41J 11/56; B41J 13/10

[52] U.S. Cl. ..... 400/680; 400/625; 400/685; 400/691

[58] Field of Search ..... 400/624, 625, 629, 635, 400/647, 647.1, 680, 685, 690.4, 691, 693

[56] References Cited

U.S. PATENT DOCUMENTS

| | | | |
|---|---|---|---|
| 2,574,575 | 11/1951 | MacIntyre | 400/706 |
| 3,430,748 | 3/1969 | Parri | 400/629 |
| 4,372,699 | 2/1983 | Quinn, Jr. | 400/625 |
| 4,676,679 | 6/1987 | Kondo | 400/54 |
| 4,739,316 | 4/1988 | Yamaguchi et al. | 400/680 |
| 4,789,259 | 12/1988 | Katayanagi | 400/624 |
| 4,808,017 | 2/1989 | Sherman et al. | 400/680 |
| 4,821,049 | 4/1989 | Eckl | 400/633 |
| 5,105,210 | 4/1992 | Hirano et al. | 400/680 |

FOREIGN PATENT DOCUMENTS

| | | | |
|---|---|---|---|
| 38822 | 3/1984 | Japan | 400/685 |
| 73980 | 4/1984 | Japan | 400/680 |
| 158274 | 7/1988 | Japan | 400/635 |

OTHER PUBLICATIONS

IBM Technical Disclosure Bulletin vol. 24 No. 8 Jan. 1982 "Cover Section for Paper Opening of a Printer".

*Primary Examiner*—Edgar S. Burr
*Assistant Examiner*—Stephen R. Funk
*Attorney, Agent, or Firm*—Horst M. Kasper

[57] ABSTRACT

A printer includes a sheet storage cassette and a sheet separation device for storing and separating individual sheets prior to printing, as well as a sheet deposit device for receiving of the printed-on individual sheets. A sheet storage cassette (2) is formed of two cassette sections (5 and 6), which can be pivoted relative to each other in order to achieve a compact construction of the printer in view of the space requirements of the sheet storage cassette. The first cassette section (5) is fixedly disposed opposite to the sheet separation device (11). The second cassette section (6) is formed as a flap cover (2), pivotally supported at the printer. The flap cover (2) forms the upper side of the printer in the closed state. The flap cover (2) is aligned with the first cassette section (5) in a flipped open state under formation of a sheet storage cassette (4).

23 Claims, 3 Drawing Sheets

PRINTER WITH SHEET STORAGE CASSETTE

CROSS REFERENCE TO RELATED APPLICATIONS

This application is a continuation-in-part application of another international application filed under the Patent Cooperation Treaty on Feb. 8, 1990 bearing Application No. PCT/DE90/00084, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The invention relates to a printer with a sheet supply and storage cassette and a sheet separating device for individualizing and feeding individual sheets to be printed on from the sheet storage cassette to a print position and with a sheet deposit device for receiving printed individual sheets coming from the print position.

2. Brief Description of the Background of the Invention Including Prior Art

Such a printer is known from the European Patent Application EP-A-0 106 801 and has provisions for mounting a fixture top attachment. The fixture top attachment can be placed onto the casing of the printer for an automatic feeding of individual sheets to be printed on into a print position from a sheet storage. The fixture top attachment exhibits an inclined disposed sheet storage cassette with a sheet separating device and a sheet deposit device for the receiving of the individual sheets coming from the print position. The device height of the printer is substantially determined by the fixture top attachment which, in addition, has to be operated separately as an auxiliary part from the printer.

A printer is known from the German Printed Patent Document DE-A-35 04 029, where the sheet storage cassette can be inserted into the casing of the printer horizontally like a drawer. This known printer also exhibits a relatively large construction size since the sheet storage cassette requires at least a base size corresponding to the individual sheet sizes.

Automatic individual sheet feed devices have not become known up to now for the reasons recited above, in particular in connection with a laptop apparatus or laptop computer or bookcase computer, where the laptop apparatus is characterized by a particularly compact construction, and where the laptop can be transported like a briefcase or in a briefcase.

SUMMARY OF THE INVENTION

1. Purposes of the Invention

It is an object of the present invention to furnish a printer with an automatic individual sheet feed, which is characterized by a particularly compact construction.

It is another object of the invention to provide a printer particularly adapted for travel use.

It is yet a further object of the invention to provide a printer for quick viewing of the print output.

It is still a further object of the invention to provide a single unit compact computer printer.

These and other objects and advantages of the present invention will become evident from the description which follows.

2. Brief Description of the Invention

The present invention provides for a compact printer with a sheet storage cassette. The sheet storage cassette has a first cassette section and a second cassette section pivotally disposed relative to each other. The second cassette section is formed as a flap cover pivotally supported at the printer. The flap cover forms in a closed state an upper side of the printer. The flap cover can be fixed in an inclined position in a flipped open state. An inner cover side of the flap cover is aligned with the first cassette section while the flap cover is in the inclined position. A sheet separating device is disposed such that the first cassette section is fixedly disposed at an inclined position opposite to the sheet separating device in the interior of the printer. The sheet separating device is constructed to engage sheets, disposed in the sheet storage cassette, and to deliver the sheets toward a print position for separating and feeding individual sheets. A sheet deposit device receives the printed-on individual sheets coming from the print position.

A print head can be disposed opposite to a print substrate support such that the sheets can be fed to pass between the print substrate support and the print head. A sheet support edge can be disposed in the printer for supporting sheets coming from the print head. The inner cover side of the flap cover can be disposed toward a position of the print head. The flap cover can include a plate disposed parallel and opposite to the inner cover side. The plate can be disposed at least substantially perpendicular to the sheet support edge in the flipped open state of the flap cover under formation of a sheet deposit device.

A switching element can be disposed on a side of the printer facing the flap cover for a switching of printer functions. The switching element can be switched by a closing of the flap cover. A nose can be disposed on the flap cover for engaging and switching the switching element.

An endless conveyor belt having a transport surface, can be disposed opposite to the print head for transporting the sheets and for providing the print substrate support. The transport surface of the conveyor belt can be disposed in a plane which intersects a plane of the flap cover in a flipped open state of the flap cover at an angle of less than 5 angular degrees.

A microprocessor can be connected to the print head for controlling the operation of the print head. A computer screen can be disposed immediately adjacent to the second cassette section and can be connected to the microprocessor. A memory storage can be connected to the microprocessor. A lock can lock the screen and the storage cassette to the keyboard. A movable stop edge at the bottom of the cassette storage can hold the paper sheet in an engagement position with the sheet separating device and can move the sheets into the second cassette position when the computer and printer are not in operation.

Mass memory storage means can be connected to the microprocessor. The screen can be disposed in a plane intersecting a plane of the conveyor belt at an angle of less than 10 degrees in the operating position of the printer.

A single frame can be provided for the printer and the microprocessor. A sheet stop can be disposed at the filling end of the sheet storage cassette. Guidance means can be provided for sheets ejected from the sheet storage cassette.

According to the invention the sheet storage cassette is formed by two cassette sections which can be pivoted relative to each other in case of a printer of the above recited kind. The first cassette section is disposed in the interior of the printer fixedly in an inclined position opposite to the sheet separating device. The second cassette section is shaped as a flap cover supported hingedly at the printer, where the flap cover forms the upper side of the printer in a closed state, and where the pivoting cover can be fixed in an inclined position in the flipped open state where the cover inner side is aligned with the first cassette section when the cassette section is fixed in an inclined position.

It is achieved by the subdivision of the sheet storage cassette into the two cassette sections, pivotable relative to each other, that the second cassette section, formed as a flap cover, can be shorter by the linear length of the first cassette section fixed in the printer, than the length of the individual sheets to be received by the sheet storage cassette. This means that the construction length of the printer, which is determined by the length of the flap cover, and the device height and construction height of the printer, which corresponds approximately to the length of the first cassette section, do not need to be larger in their sum value than the length of an individual sheet, such that a very compact construction of the printer of the invention can be achieved overall.

The length of the flap cover, however, need not be smaller than the individual sheets. Even in cases where the flap cover is approximately of the same size as the individual sheets there is still achieved a compact printer construction, in order to serve as a storage for the keeping ready of the individual sheet storage as will be described further below according to a further advantage of the printer of the invention.

Finally, the flap cover serves in an advantageous way both as a protection and a cover for sensitive parts of the printer during its transport, as well as a protection for the respective transport means for example, a brief case, versus the sharp-edged parts of the printer.

It is sufficient for the operation of the printer of the invention to flip open the flap cover into an inclined position, such that this flap cover, together with the fixed cassette section, forms in the interior of the printer a sheet storage cassette adapted to the individual sheets to be stored.

According to a particularly advantageous further embodiment of the printer of the invention, the flap cover exhibits a plate disposed opposite and parallel to the inner side of the cover. The plate is disposed at least approximately perpendicular to a sheet support edge disposed in the printer in the flipped open state of the flap cover under formation of the sheet deposit position. It is thereby achieved in an advantageous way that the flap cover serves simultaneously as a sheet storage cassette for the individual sheets to be printed on, as well as a sheet deposit for receiving the printed individual sheets coming from the print position. The printed individual sheets fed and discharged into the sheet deposit stand with their lower sheet edges on the sheet support edge and rest at the inclined disposed plate. A further advantage can be recognized in that the plate forms together with the cover inner side a pocket-shaped storage for receiving a storage of individual sheets or, for example, an operating instruction manual for the printer.

It is further disclosed that the printer can exhibit on its side disposed toward the flap cover a switching element, actuatable by the closing of the flap cover, for switching of the printer functions, with a view to enhance the easy transportability of the printer of the invention. The circumstance is employed here in an advantageous way that feeding of the individual sheets to be printed and thus an operation of the printer is possible only in case of an open flap cover such that the closing of the flap cover can be used for the interruption of the printing operation of the printer or for a switch-on prevention. Thus, the switching element can for example be a transport security device, which transport security device, in case of a closed flap cover, restrains movable parts of the printer such as, for example, the print works, and which releases same only upon an opening of the cover. Furthermore, the switching element can be a power connection switch, which is accessible only in case of an open flap cover and which is automatically switched into an off-position with the closing of the flap cover. Finally, a sealing of the ink print head can be achieved with a closed flap cover via the switching element in case of an ink jet printer.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
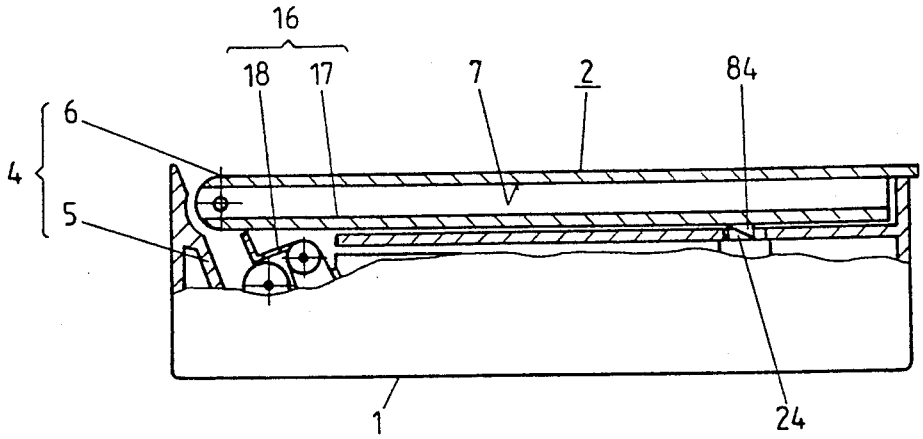
FIG. 1 is a longitudinal sectional view of a printer in a storage and transportation state.

According to the present invention, there is provided a printer with a sheet storage cassette and a sheet separating device for separating and feeding individual sheets to be printed on from a sheet storage cassette into a print position. A sheet deposit device is provided for receiving the printed-on individual sheets coming from the print position. The sheet storage cassette 4 comprises two cassette sections 5, 6, pivotally disposed relative to each other. The first cassette section 5 is fixedly disposed in an inclined position opposite to the sheet separating device 11 in the interior of the printer. The second cassette section 6 is formed as a flap cover 2, pivotally supported at the printer. The flap cover 2 forms the upper side of the printer in the closed state. The flap cover 2 can be fixed in an inclined position in the flipped open state. The inner cover side 7 is aligned with the first cassette section 5, while the flap cover 2 is in the inclined position.

The flap cover 2 can exhibit a plate 17, disposed parallel and opposite to the inner cover side 7. Said plate 17 can be disposed, in the flipped open state of the flap cover 2 under formation of a sheet deposit device 16, at least approximately perpendicular to a sheet support edge 18, disposed in the printer.

The printer can exhibit a switching element 24 for a switching of printer functions. The switching element can be switched by a closing of the flap cover 2 and can be disposed on a side of the printer facing the flap cover 2.

Figure 2:
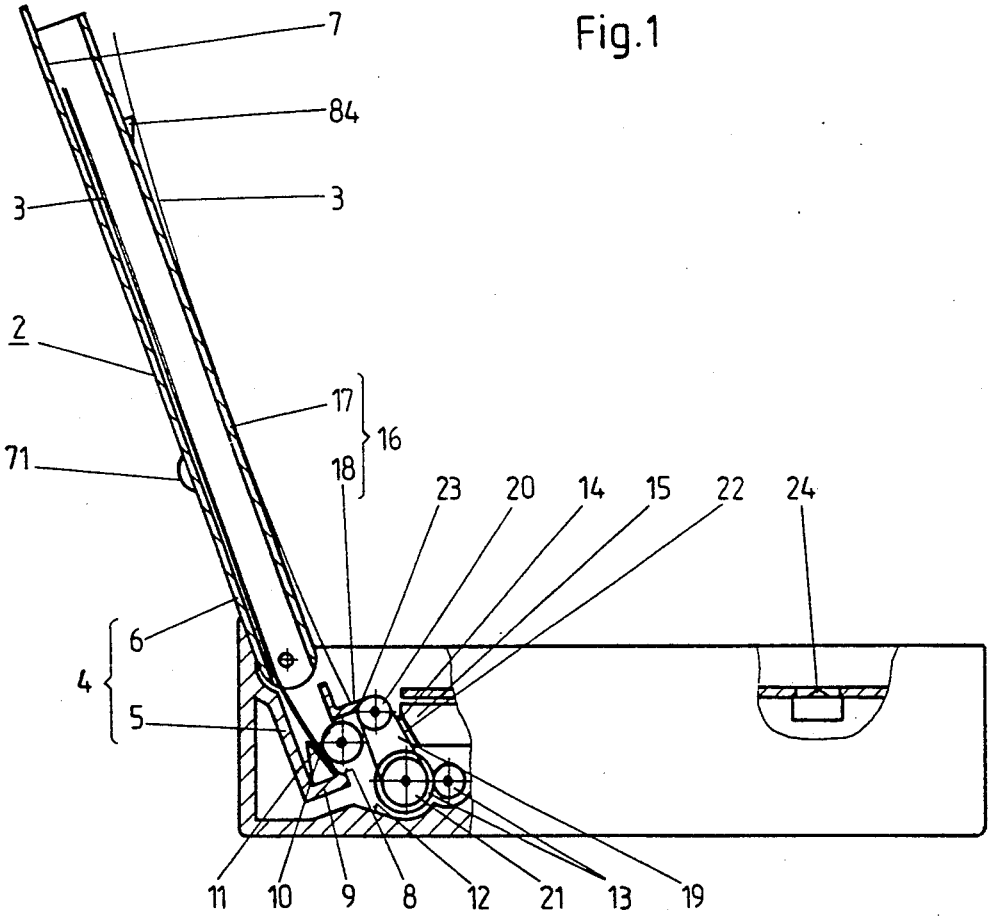
FIG. 2 is a longitudinal sectional view of the printer of FIG. 1 in an operating state.

FIGS. 1 and 2 show in part a longitudinal section of the parts of a printer essential for the explanation and illustration of the invention. The printer exhibits a flat box-shaped casing 1, where a flap cover 2 is pivotally supported at the side of the casing 1. The flap cover 2 forms in a closed state the upper side of the casing 1 according to the representation in FIG. 1. The flap cover 2 is part of a sheet storage cassette 4, serving for receiving the individual sheets 3 to be printed on. The sheet storage cassette 4 comprises a first cassette section 5, fixedly disposed in an inclined position in the interior of the casing 1, and a second cassette section 6, which is formed by the flap cover 2. As illustrated in FIG. 2, the flap cover 2 can be fixed in the flipped open state in an inclined position, in which position the cover inner side 7 is aligned with the first cassette section 5 in the interior of the casing 1, such that the two cassette sections 5 and 6 form a joint support plane for the individual sheets 3 to be printed on. Said individual sheets 3 are supported with their lower sheet edges on a stop edge 9, formed at a right angle at the first cassette section 5 and furnished with sheet separating edges 8. The individual sheets 3 are pressed by a spring 10 in the region of the first cassette section 5 against a drivable roller of a sheet separating device 11. The drivable roller serves to withdraw the uppermost individual sheet 3 in each case from the individual sheets 3 contained in the sheet storage cassette 4, and to guide the uppermost individual sheet 3 along a guide tray 12, formed in the bottom region of the casing 1, into the draw-in slot of a transport roller pair 13. The transport roller pair 13 is disposed immediately below the print position 14 of an ink print head 15. The guide roller pair 13 serves the purpose to guide the individual sheet 3 to be printed on in each case upwardly along the ink print works 15 with a defined line advance speed, while the individual sheet 3 is printed on by the ink jet print works 15 in the print position 14.

A sheet deposit device 16, comprising a plate 17, disposed parallel opposite to the flap cover 2 of the inner cover side 7, serves for receiving of the printed-on individual sheets 3 coming in each case from the print position 14. In a flipped-open state of the flap cover 2, the plate 17 is disposed nearly perpendicular to a sheet support edge 18 fixedly disposed in the interior of the casing 1. A gripper device 19, formed as a belt 22 guided over two deflection rollers 20 and 21, serves for transporting the printed-on individual sheets 3 into the sheet deposit device 16. The plane of the transporting surface of the belt 22 facing the print head can enclose an angle of less than about 5 degrees with the plane of the plate 17. The belt 22 exhibits an outwardly disposed projection formed like a gripper hook 23. When the printed-on individual sheet 3 leaves the transport roller pair 13 with its lower sheet edge at the end of the printing process, then one of the two deflection rollers 20 or 21 is driven such that the gripper hook 23 of the belt 22 grips and engages the printed-on individual sheet 3 at its lower sheet edge and transports the printed-on individual sheet 3 out of the print position 14. In the region of the upper deflection roller 20, the individual sheet 3 is lifted over this deflection roller 20 and falls subsequently onto the sheet support edge 18 of the sheet deposit device 16.

The plate 17 forms together with the inner cover side 7 a pocket-shaped storage, for example, for receiving an operating instruction manual for the printer or, in case of corresponding outer dimensions of the flap cover 2, for the storage of a stack of individual sheets 3. In the latter case, the length of the flap cover 2 corresponds to the length of an individual sheet whereas in other cases, as is shown in particular in FIG. 2, the length of the flap cover 2 is shorter by about the width amount of the first cassette section 5 as compared to the individual sheet length, such that the printer exhibits overall a very compact construction.

Since an operation of the printer is intended only in case of an open flap cover 2, the opening and closing of the flap cover 2 simultaneously switches on essential printer functions or shuts off such printer functions. According to the illustrated embodiment the printer includes for this purpose on its side disposed toward the flap cover 2 with a nose 84 a switching element 24, formed as an ON/OFF power switch. This switching element 24 can be actuated by a closing of the flap cover 2. The printer can be manually switched on and shut off manually in case of an open flap cover 2. The printer is automatically shut off in case of a closing of the flap cover 2. Additional possibilities not illustrated here for the switching of the printer functions via a switching element, actuated by the flap cover 2, relate to the arresting of movable printer parts or to the sealing of the ink jet print works 15.

Figure 3:
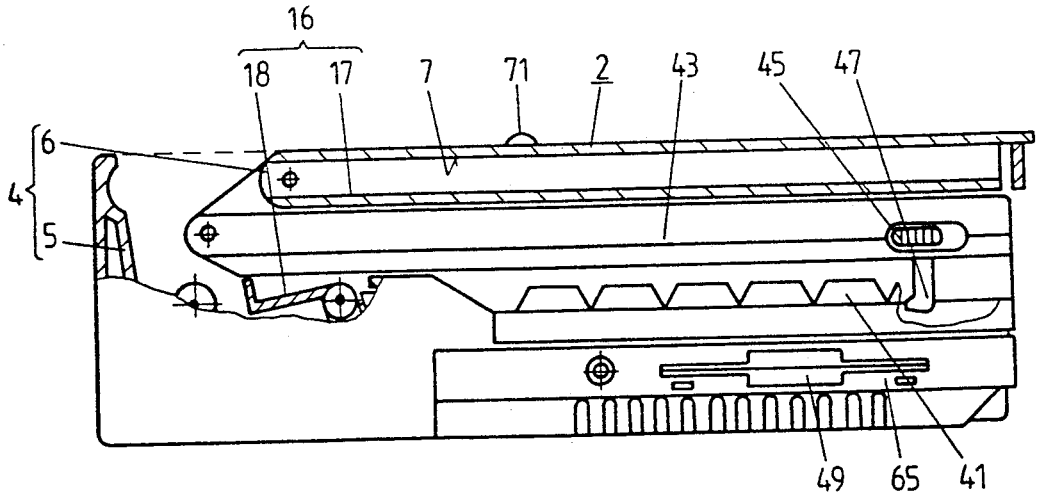
FIG. 3 is a longitudinal sectional view of a printer similar to the printer of FIG. 1, however, including a computer performing the driver function of the printer.
Figure 4:
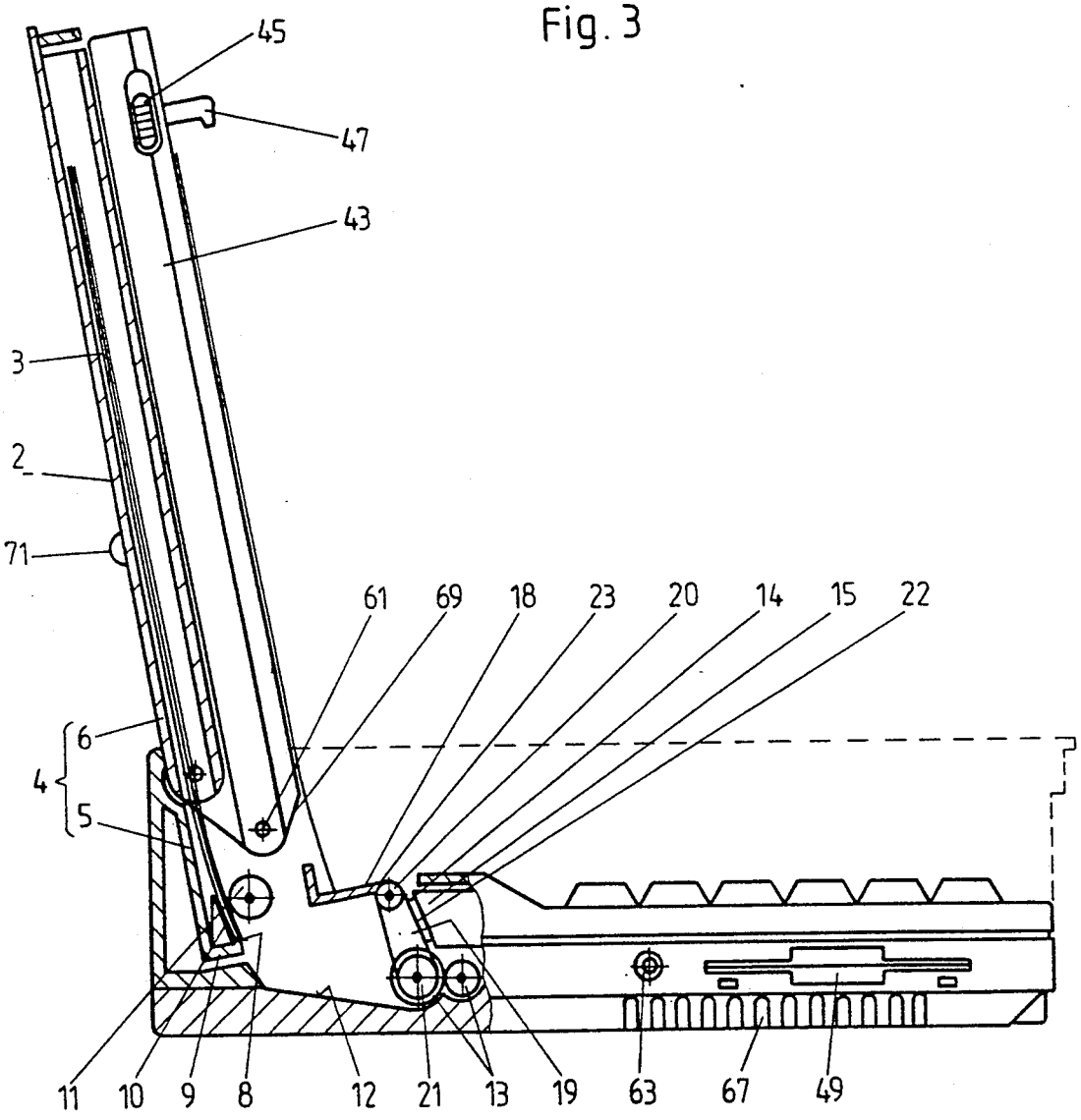
FIG. 4 is a longitudinal sectional view of the printer of FIG. 3 in the operational state.
Figure 5:
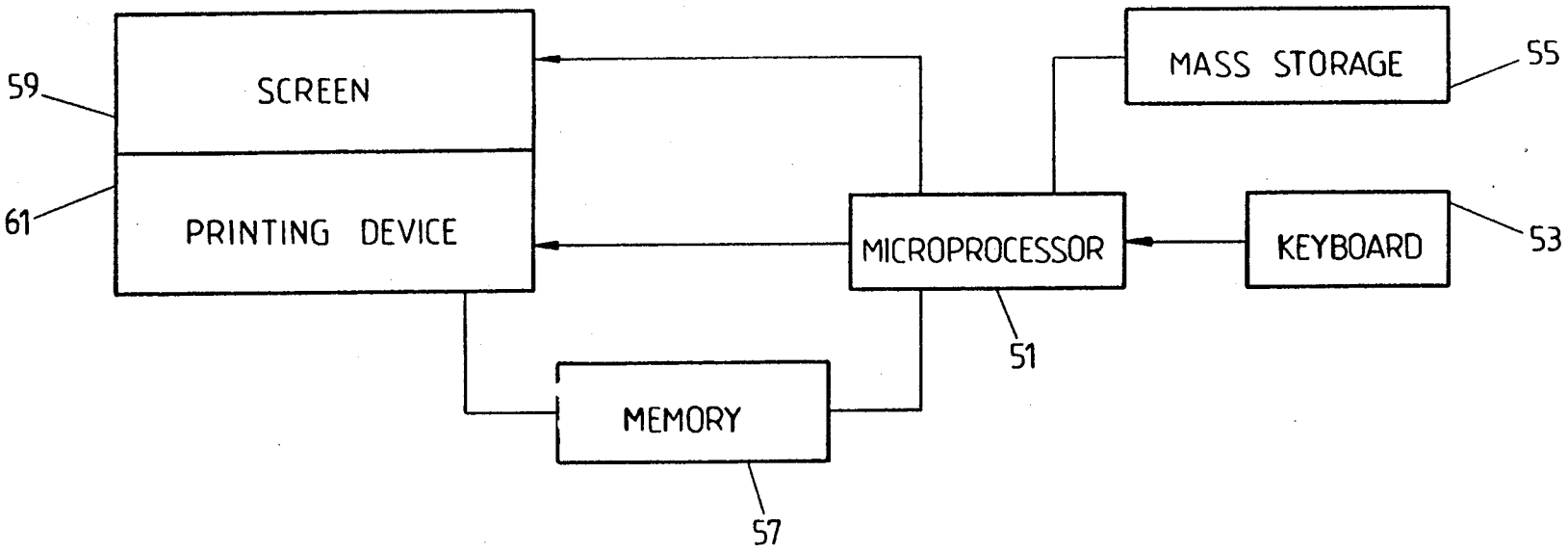
FIG. 5 is a schematic diagram of the electrical plug connections between the components of the device of FIGS. 3 and 4.

FIG. 3 illustrates a printer with a keyboard 41 and a screen 43 disposed in the storage position immediately facing each other. A lock 45 can be provided together with a hook 47 for retaining the screen 43 opposite to the keyboard 41. The screen 43 is attached to the plate 17 and is disposed in a substantially parallel plane relative to a plane for the sheet storage cassette 4. The keyboard 41 and the screen 43 are part of a computer which operates as a laptop computer. The computer comprises, as schematically illustrated in FIG. 5, a microprocessor 51, which is connected to the keyboard 53. A mass storage 55 is connected to the microprocessor 51. The microprocessor 51 is further connected to a memory 57, for example, a random access memory. The output signals are fed from the microprocessor 51 to the screen 59 and to the printing device 61, where such a printing device 61 or, respectively, such a screen 59 is connected to the microprocessor 51. Optionally, the memory 57 can be connected to the printing device 61. The microprocessor 51 can perform the driving and control functions for the printing device 61. Furthermore, FIG. 3 shows a disk drive 49 which can provide the mass memory storage or part of the mass memory storage 55, illustrated in FIG. 5. FIG. 4 illustrates the laptop computer printer of FIG. 3 in the operational state. Similar to the embodiment of FIG. 2, the paper sheet 3 is drawn into the printer. However, since the sheet storage cassette 4 and the screen 43 of the computer involve a wider spacing, the path of the paper sheet 3 is not curved as strongly as would be the case if only the section of the sheet storage cassette 4 would be available and the printed-on sheet 3 would rest against the plate 17 instead of the screen 43. The location of the hinge axis 61 for the screen 43 and the sheet storage cassette 4 is firmly above the level of the keys of the keyboard 41. The hinge axis 61 allows to move simultaneously the sheet storage cassette 4 and the video screen 43. Outer connections can be provided to the casing such as the element 63, which would be used for a connection to a DC voltage supply. The incorporation of the computer and the printer is associated with the advantage that an immediate control of the printer can be furnished by the computer. In addition, this combination saves space and is particularly useful for travel applications as all required components for practical use of a computer in a correspondence and word processing situation are provided. Preferably, a solid frame 65 holds both the components required for the printer and for the computer operation together. Ventilation openings 67 can be provided to allow cooling by convective thermal transport. Any gap which occurs between the angle surface of the sheet support edge 18 and the lower edge 69 of the screen 43 is formed such that the paper will slide upwardly along the screen 43 after being imprinted.

In addition, a hook 71 can be provided which allows to reposition and to shift the edge of a sheet into the hinged section of the sheet storage. It is shown in FIG. 4 that a sheet 3 of &he sheet storage cassette 4 rests on a stop edge 9. The stop edge 9 can be made movable and retractable such that the entire sheet supply can be withdrawn into the area between the inner cover side 7 and the plate 17. This avoids any possibility of damaging and bending the paper sheets during operation and transport.

According to a preferred embodiment, the paper sheet storage is furnished such that the longitudinal direction of the sheet is parallel to the hinge axis 61. This will require that printing a landscaping orientation is employed in case of a printout. However, this configuration is advantageous as it allows simultaneously to employ the most suitable rectangular, horizontally extended screen 43 while allowing a storage of the customary paper sheet sizes. The microprocessor 51, together with the memory storage 57, can control and steer the printer into landscape operation. In this case, the hinge axis 61 would be longer than the sectional base of the apparatus illustrated in the plane of FIG. 4 of the computer printer.

Thus, there is furnished a unified device which provides the computer and word processing advantages and in a notebook- or laptop-sized device.

It will be understood that each of the elements described above, or two or more together, may also find a useful application in other types of storage and supply cassette systems differing from the types described above.

While the invention has been illustrated and described as embodied in the context of a printer with a sheet storage cassette, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A compact printer comprising:

a sheet storage cassette, wherein the sheet storage cassette comprises a first cassette section and a second cassette section pivotally disposed relative to each other, the second cassette section forming a flap cover pivotally supported at the printer, wherein the flap cover forms in a closed state an upper side of the printer, the flap cover being fixable in an inclined position in a flipped open state, the flap cover having an inner cover side facing an interior of the printer while in the closed state, and wherein the inner cover side of the flap cover is aligned with the first cassette section while the flap cover is in the inclined position;

the flap cover further including a plate;

a sheet separating device disposed in the interior of the printer such that the first cassette section is fixedly disposed at an inclined position opposite to the sheet separation device, wherein the sheet separation device is constructed to engage sheets disposed in the first cassette section, and to deliver the sheets toward a print position and for separating and feeding individual sheets;

a sheet deposit device formed by the plate of the flap cover for receiving printed-on individual sheets coming from the print position.

2. The printer according to claim 1, further comprising a print substrate support;

a print head disposed opposite to the print substrate support such that the sheets are fed to pass between the print substrate support and the print head.

3. The printer according to claim 1, further comprising a switching element disposed on a side of the printer facing the flap cover for a switching of printer functions, wherein the switching element is switchable by a closing of the flap cover.

4. The printer according to claim 3 further comprising a nose disposed on the flap cover for engaging and switching the switching element.

5. The printer according to claim 1, further comprising an endless conveyor belt having a transport surface and disposed opposite to a print head for transporting the sheets and for providing a print substrate support; wherein the sheet deposit device is disposed at the second cassette section.

6. The printer according to claim 5, wherein the transport surface of the conveyor belt is disposed in a plane which intersects a plane of the flap cover in a flipped open state of the flap cover at an angle of less than 5 angular degrees.

7. The printer according to claim 1 further comprising a print head;

a microprocessor connected to the print head for controlling the operation of the print head;

a computer screen disposed immediately adjacent to the second cassette section and connected to the microprocessor;

a memory storage connected to the microprocessor.

8. The printer according to claim 7, further comprising a lock for locking the screen and the sheet storage cassette to a keyboard.

9. The printer according to claim 7, further comprising, a mass memory storage connected to the microprocessor;

wherein the screen is disposed in a plane intersecting a plane of a conveyor belt disposed in the printer and facing the print head at an angle of less than 10 degrees in an operating position of the printer.

10. The printer according to claim 7, further comprising a single frame for the printer and the microprocessor;

a sheet stop located at a filling end of the first cassette section;

guidance means for sheets ejected from the sheet storage cassette.

11. A compact printer comprising a sheet storage cassette, wherein the sheet storage cassette comprises a first cassette section and a second cassette section pivotally disposed relative to each other, and wherein the second cassette section is formed as a flap cover pivotally supported at the printer, wherein the flap cover forms in a closed state an upper side of the printer, and wherein the flap cover can be fixed in an inclined position in a flipped open state, and wherein an inner cover side of the flap cover is aligned with the first cassette section while the flap cover is in the inclined position;

a sheet separating device disposed such that the first cassette section is fixedly disposed at an inclined position opposite to the sheet separation device in an interior of the printer, and wherein the sheet separation device is constructed to engage sheets, disposed in the sheet storage cassette, and to deliver the sheets toward a print position for separating and for feeding individual sheets;

a sheet deposit device for receiving the printed-on individual sheets coming from said print position, further comprising a print substrate support;

a print head disposed opposite to the print substrate support such that the sheets are fed to pass between the print substrate support and the print head, a sheet support edge disposed in the printer for supporting sheets coming from the print head, wherein the inner cover side of the flap cover is disposed toward a position of the print head, and wherein the flap cover includes a plate disposed parallel and opposite to the inner cover side, where the plate is disposed at least substantially perpendicular to the sheet support edge in the flipped open state of the flap cover providing the sheet deposit device.

12. A compact printer comprising:

a sheet separation device for an interior of the printer;

a first cassette section fixedly disposed at an inclined position opposite to the sheet separation device;

a second cassette section disposed relative to the first cassette section and forming a flap cover pivotally supported relative to the first cassette section and forming together with the first cassette section a sheet storage cassette, and the flap cover forming an upper side of the printer in a closed state of the flap cover, the flap cover being fixable in an inclined position in a flipped open state, the flap cover having an inner cover side facing the interior of the printer in the closed state, wherein the inner cover side of the flap cover is aligned with the first cassette section while the flap cover is in the inclined position, wherein the sheet separating device is constructed to engage sheets disposed in the sheet storage cassette, and to deliver the sheets toward a print position and for separating and feeding individual sheets;

the flap cover further including a plate;

a sheet deposit device formed by the plate of the flap cover for receiving printed-on individual sheets coming from the print position.

13. The printer according to claim 12, further comprising a printer casing;

a print substrate support;

a print head disposed opposite to the print substrate support such that the sheets are fed to pass between the print substrate support and the print head.

14. The printer according to claim 12, further comprising a switching element disposed on a side of the printer facing the flap cover for a switching of printer functions, wherein the switching element is switchable by a closing of the flap cover.

15. The printer according to claim 12, further comprising a switching element for switching printer functions;

a nose disposed on the flap cover for engaging and switching the switching element.

16. The printer according to claim 12, further comprising an endless conveyor belt having a transport surface and disposed opposite to a print head for transporting the sheets and for providing a print substrate support.

17. The printer according to claim 16, wherein the transport surface of the conveyor belt is disposed in a plane which intersects a plane of the flap cover in a flipped open state of the flap cover at an angle of less than 5 angular degrees.

18. A compact printer comprising a sheet separation device for an interior of the printer;

a first cassette section fixedly disposed at an inclined position opposite to the sheet separation device;

a second cassette section pivotally disposed relative to the first cassette section and formed as a flap cover pivotally supported relative to the first cassette section and forming together with the first cassette section a sheet storage cassette, and with the flap cover forming an upper side of the printer in a closed state of the flap cover, and wherein the flap cover can be fixed in the inclined position in a flipped open state, and wherein an inner cover side of the flap cover is aligned with the first cassette section while the flap cover is in the inclined position, and wherein the sheet separating device is constructed to engage sheets, disposed in the sheet storage cassette, and to deliver the sheets toward a print position for separating and for feeding individual sheets;

a sheet deposit device for receiving the printed-on individual sheets coming from said print position, further comprising a printer casing;

a print substrate support;

a print head disposed opposite to the print substrate support such that the sheets are fed to pass between the print substrate support and the print head;

a sheet support edge disposed in the printer for supporting sheets coming from the print head, wherein the inner cover side of the flap cover is disposed toward a position of the print head, and wherein the flap cover includes a plate disposed parallel and opposite to the inner cover side, where the plate is disposed at least substantially perpendicular to the sheet support edge in the flipped open state of the flap cover for forming the sheet deposit device.

19. A printer comprising:

a sheet storage cassette and, a sheet separating device for separating and feeding individual sheets to be printed on from the sheet storage cassette into a print position, a sheet deposit device for receiving printed-on individual sheets coming from the print position, the sheet storage cassette (4) comprising two cassette sections (5, 6) pivotally disposed relative to each other, wherein the first cassette section (5) is fixedly disposed in an inclined position in an interior of the printer opposite to the sheet separation device (11), the second cassette section (6) forming a flap cover (2) pivotally supported at the printer, wherein the flap cover (2) forms in a closed state an upper side of the printer, the flap cover (2) being fixable in an inclined position in a flipped open state, the flap cover having an inner cover side facing the interior of the printer when in the closed state, wherein the inner cover side (7) is aligned with the first cassette section (5), while the flap cover (2) is in the inclined position, a plate disposed on the flap cover forming the sheet deposit device.

20. Printer with a sheet storage cassette and a sheet separating device for separating and feeding individual sheets to be printed on from the sheet storage cassette into a print position, a sheet deposit device for receiving the printed-on individual sheets coming from the print position, wherein the sheet storage cassette (4) comprises two cassette sections (5, 6), pivotally disposed relative to each other, wherein the first cassette section (5) is fixedly disposed in an inclined position opposite to the sheet separation device (11) in an interior of the printer, and wherein the second cassette section (6) is formed as a flap cover (2), pivotally supported at the printer, wherein the flap cover (2) forms in a closed state an upper side of the printer, and wherein the flap cover (2) can be fixed in an inclined position in a flipped open state, wherein an inner cover side (7) of the flap cover is aligned with the first cassette section (5), while the flap cover (2) is in the inclined position, wherein the printer is provided with a sheet support edge disposed in the printer wherein the flap cover (2) comprises a plate (17), disposed parallel and opposite to the inner cover side (7), where the plate (17) is disposed, in the flipped open state of the flap cover (2) for forming the sheet deposit device (16), substantially perpendicular to the sheet support edge (18), disposed in the printer.

21. Printer according to claim 20, wherein the printer comprises a switching element (24) for a switching of printer functions, wherein the switching element is switchable by a closing of the flap cover (2) and is disposed on a side of the printer facing the flap cover (2).

22. A compact printer comprising:

a printer casing;

a sheet storage cassette pivotally connected to the printer casing, the sheet storage cassette forming a flap cover, wherein the flap cover forms in a closed state an upper side of the printer casing, and the flap cover being fixable in an inclined position in a flipped open state; a sheet separating device disposed in an interior of the printer casing such that the sheet storage cassette is fixedly disposed opposite to the sheet separation device, wherein the sheet separation device is constructed to engage sheets disposed in the sheet storage cassette, and to deliver the sheets toward a print position and for separating and feeding individual sheets;

the flap cover further including an integral plate spaced from the flap cover;

a sheet deposit device formed by the plate of the flap cover for receiving printed-on individual sheets coming from the print position.

23. A compact printer comprising:

a printer casing;

a sheet storage cassette pivotally connected to the printer casing, the sheet storage cassette forming a flap cover, wherein the flap cover forms in a closed state an upper side of the printer casing, and the flap cover being fixable in an inclined position in a flipped open state; a sheet separating device disposed in an interior of the printer casing such that the sheet storage cassette is fixedly disposed opposite to the sheet separation device, wherein the sheet separation device is constructed to engage sheets disposed in the sheet storage cassette, and to deliver the sheets toward a print position and for separating and feeding individual sheets;

a video screen formed on an internal side of the flap cover facing the interior of the casing when the flap cover is in the closed state;

a sheet deposit device formed by the video screen for receiving printed-on individual sheets coming from the print position.

* * * * *